US008220946B1

(12) United States Patent
Teetzel

(10) Patent No.: US 8,220,946 B1
(45) Date of Patent: Jul. 17, 2012

(54) MODULAR FLASHLIGHT APPARATUS FOR FIREARM

(75) Inventor: James W. Teetzel, York, ME (US)

(73) Assignee: Wilcox Industries Corp., Newington, NH (US)

( * ) Notice: Subject to any disclaimer, the term of this patent is extended or adjusted under 35 U.S.C. 154(b) by 1056 days.

(21) Appl. No.: 12/055,876

(22) Filed: Mar. 26, 2008

Related U.S. Application Data

(63) Continuation-in-part of application No. 11/591,886, filed on Nov. 1, 2006, now Pat. No. 7,866,083.

(60) Provisional application No. 60/920,109, filed on Mar. 26, 2007.

(51) Int. Cl.
*F41G 1/34* (2006.01)

(52) U.S. Cl. ..... 362/110; 362/113; 362/114; 42/146; 89/200

(58) Field of Classification Search ..... 362/110–114; 42/146; 89/200
See application file for complete search history.

(56) References Cited

U.S. PATENT DOCUMENTS 3,739,167 A * 6/1973 Avery ..... 362/157
5,685,105 A * 11/1997 Teetzel ..... 42/146
6,230,431 B1 * 5/2001 Bear ..... 42/117

* cited by examiner

*Primary Examiner* — Jason Moon Han
(74) *Attorney, Agent, or Firm* — McLane, Graf, Raulerson & Middleton, Professional Association

(57) ABSTRACT

The present disclosure relates to a flashlight apparatus including a base module having a mount adaptor mountable on a firearm, a modular headpiece attached to the base module, a power source module removably attached to the base module, and a light source module removably attachable to the headpiece.

11 Claims, 15 Drawing Sheets

MODULAR FLASHLIGHT APPARATUS FOR FIREARM

CROSS-REFERENCE TO RELATED APPLICATIONS

This application is a continuation in part of U.S. patent application Ser. No. 11/591,886, filed Nov. 1, 2006. This application also claims the priority benefit under 35 U.S.C. §119(e) of U.S. provisional patent application No. 60/920,109 filed Mar. 26, 2007. The aforementioned applications are incorporated herein by reference in their entireties.

SUMMARY

The present disclosure relates to a modular flashlight for a firearm. In one embodiment, a flashlight apparatus is provided including a base module having a mount adaptor mountable on a firearm, a modular headpiece attached to the base module, a power source module removably attached to the base module, and a light source module removably attachable to said headpiece.

In another embodiment, a flashlight apparatus is provided including a base module having a mount adaptor mountable on a firearm, a modular headpiece attached to the base module, a flashlight module removably attachable to said headpiece, and an electrical connection module for powering the light source module using an outside power supply. The outside power supply being electrically coupled to the firearm to provide power to the flashlight apparatus.

BRIEF DESCRIPTION OF DRAWINGS

The invention may take form in various components and arrangements of components, and various steps and arrangements of steps. The drawings are only for purposes of illustrating preferred embodiments and are not to be construed as limiting the invention.

DETAILED DESCRIPTION OF PREFERRED EMBODIMENTS

Figure 1:
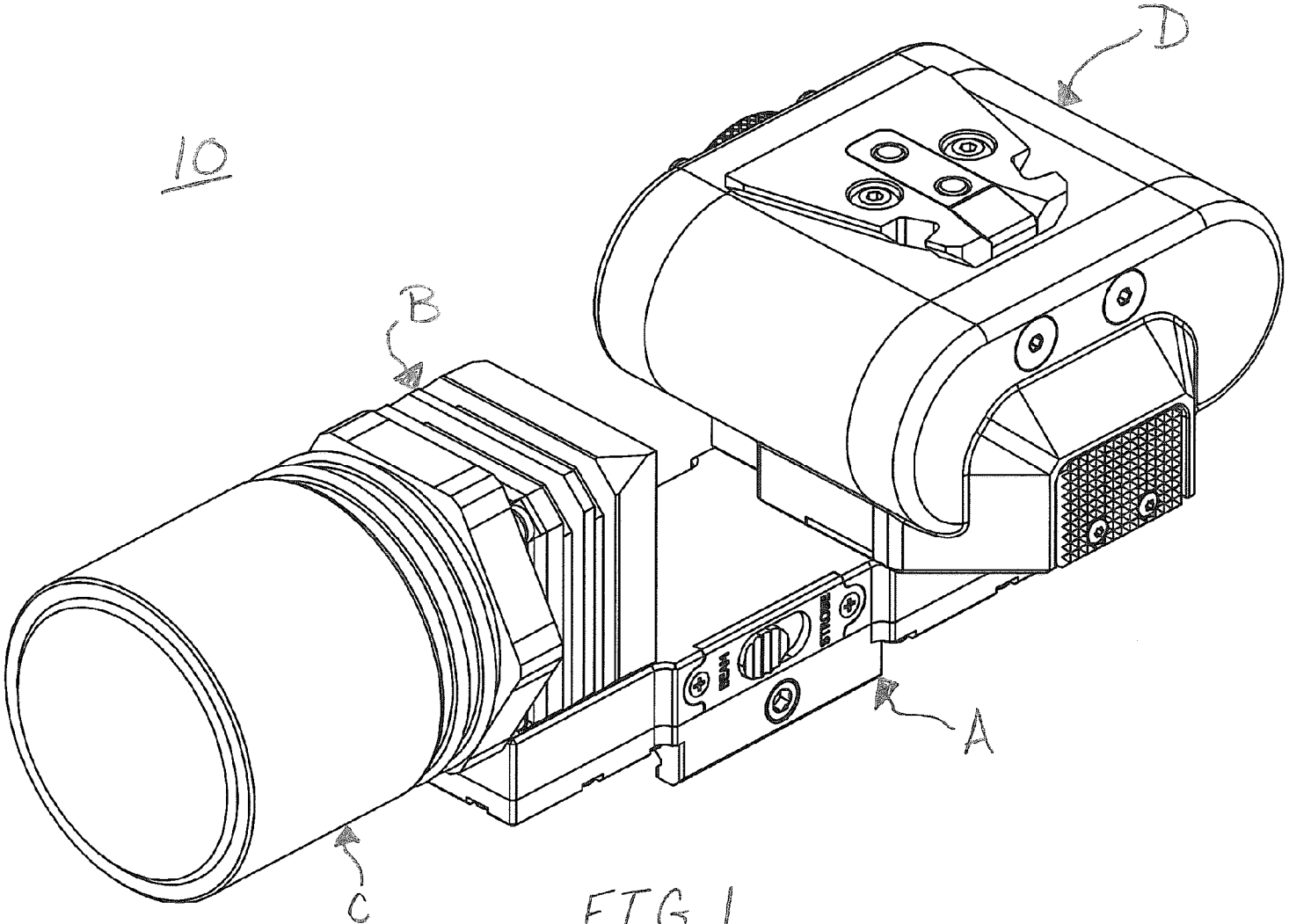
FIG. 1 is an isometric view of an assembled modular flashlight embodiment herein.
Figure 2:
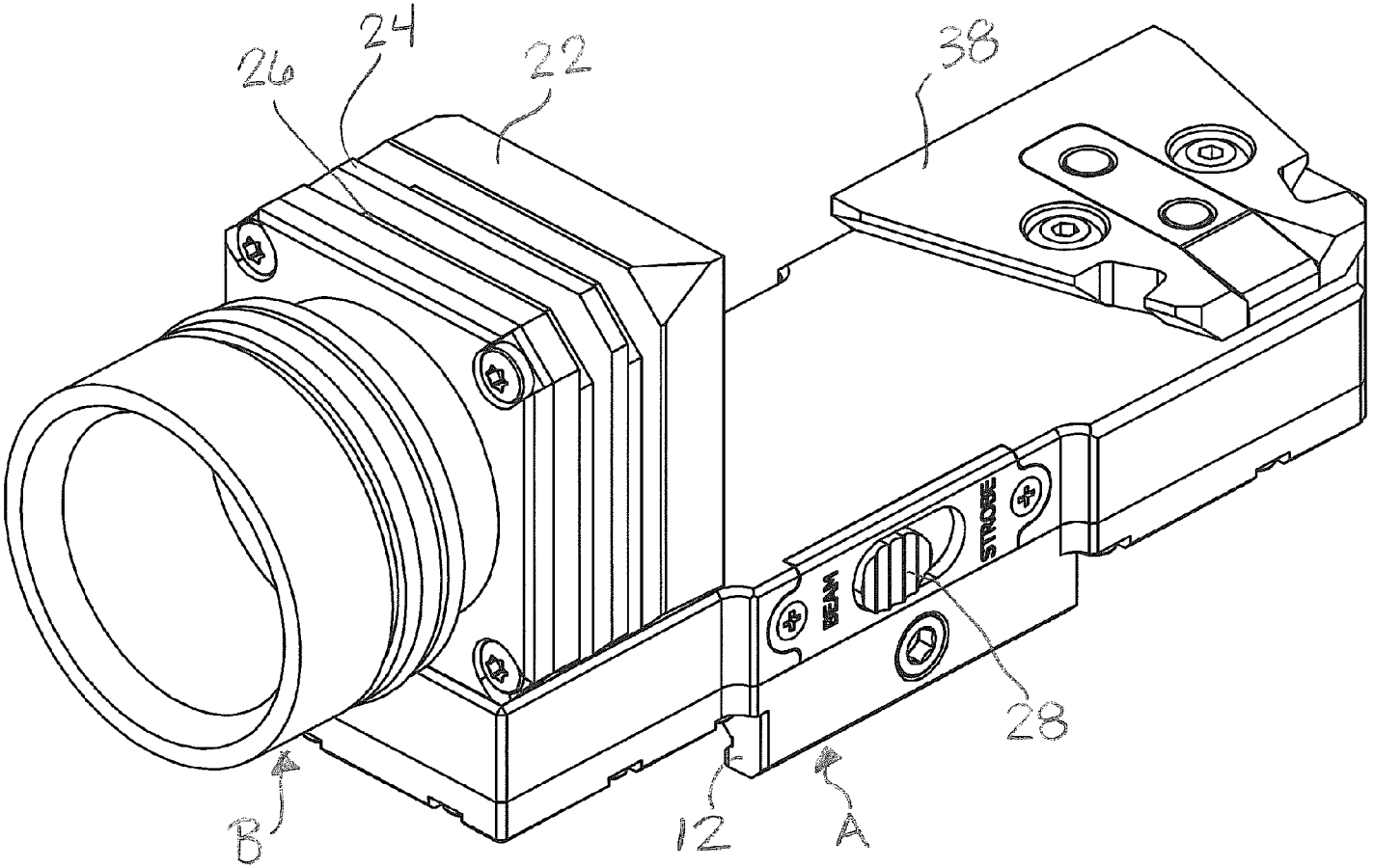
FIGS. 2 and 3 are isometric views of the FIG. 1 embodiment, with the battery pack and light source removed.
Figure 3:
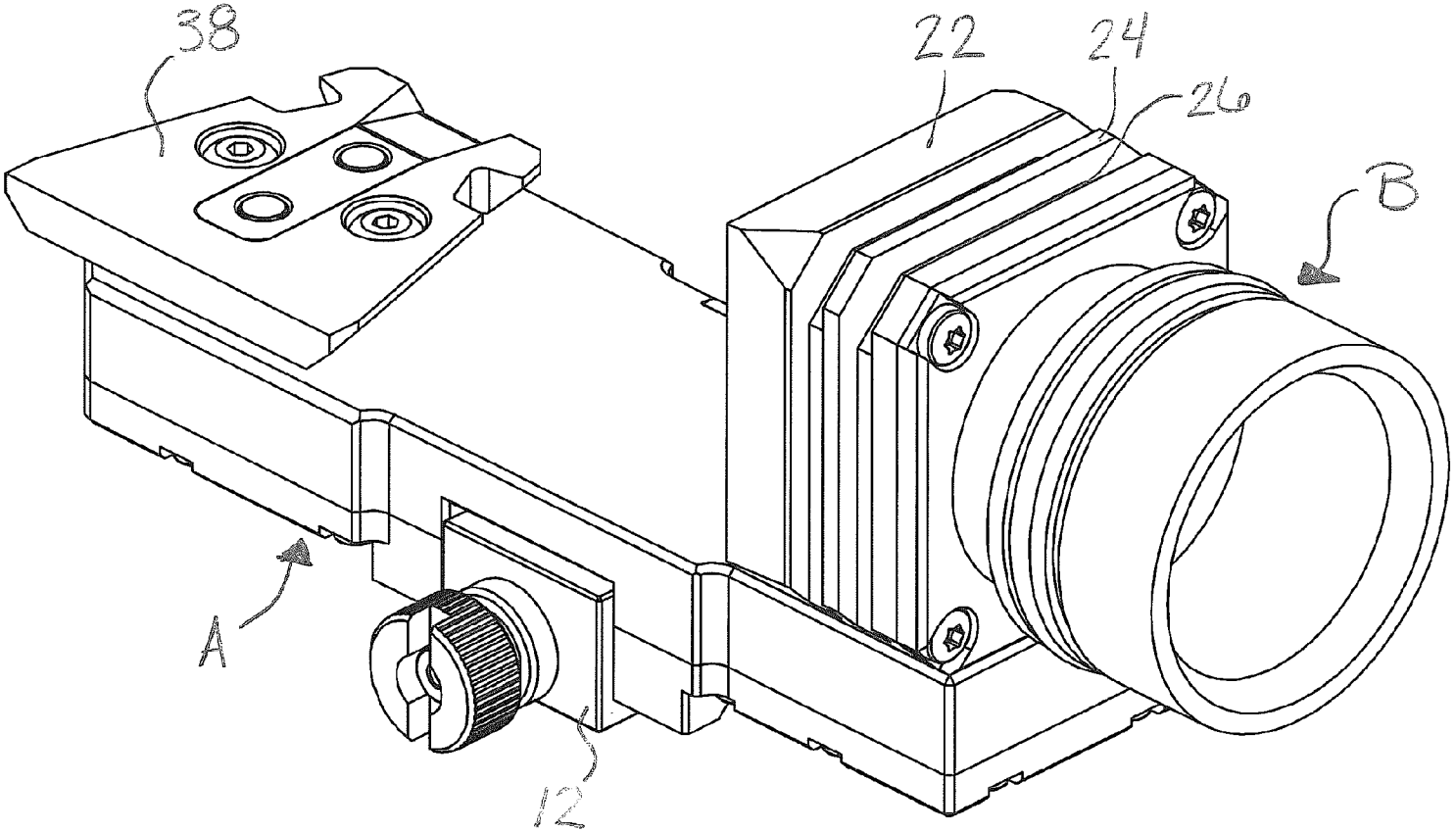
Figure 4:
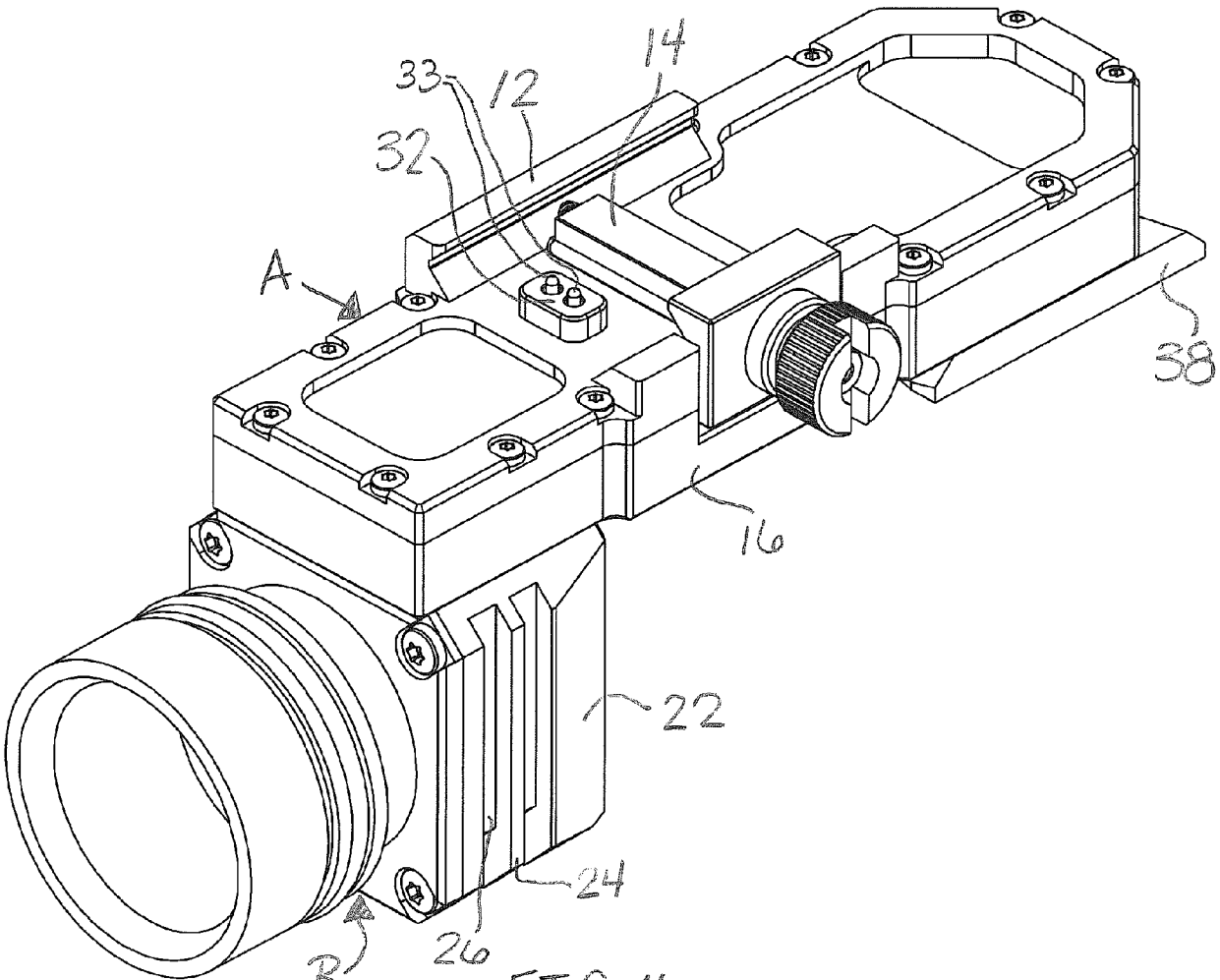
FIG. 4 is a bottom isometric view of the embodiment appearing in FIGS. 2 and 3.
Figure 5:
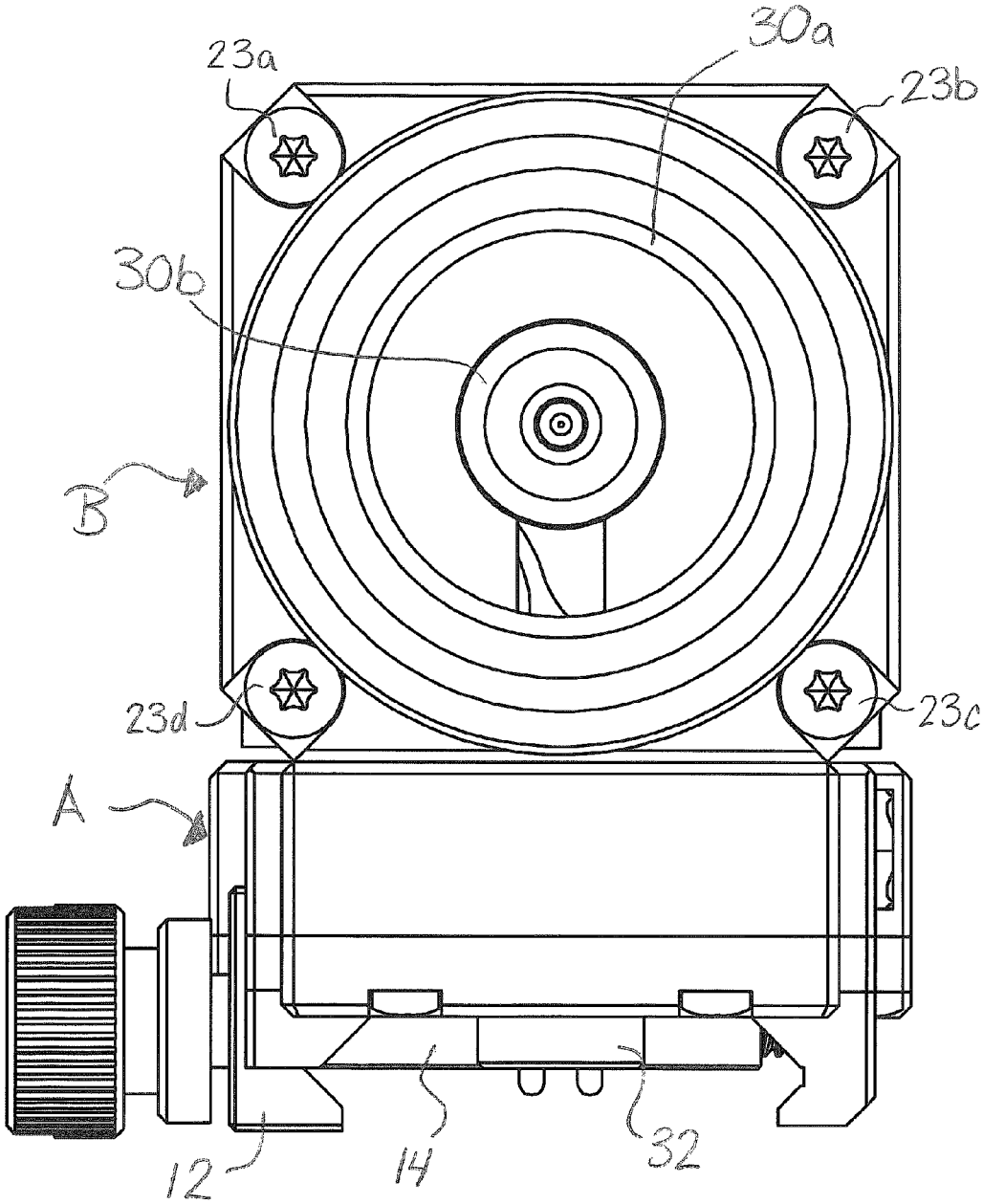
FIG. 5 is a front view of the embodiment appearing in FIGS. 2 and 3.

Referring to the drawing FIGS. 1-10 wherein like reference numerals refer to like components throughout the several views, a flashlight module 10 includes a modular base assembly A, a modular headpiece B, a light source module C, and a modular power supply assembly D.

The base assembly A includes a clamp 12 adapted for mounting on an offensive weapon such as a military rifle, handgun, or the like. In a preferred embodiment, the clamp 12 is adapted to be removably mounted to an accessory rail 18 of a military rifle 20, as seen in FIGS. 11-15. In an especially preferred embodiment, the clamp 12 includes a mount 14 adapted to mount to a Picatinny rail interface (e.g., as specified in MIL-STD-1913), such as the three point fastener described in U.S. provisional patent application No. 60/855,928 filed Nov. 1, 2006 or U.S. patent application Ser. No. 11/933,887 filed Nov. 1, 2007, which applications are herein incorporated by reference in their entireties. However, it will be recognized that the present invention may be adapted for use with all manner firearms, including without limitation rifles, handguns, machine guns, mortars, etc., and that the mounting system may be modified to accommodate other rail interface systems or weapon accessory mounting systems.

The base A includes a housing 16 housing circuit components, such as a printed circuit board or other circuit-carrying substrate. The base A includes an upstanding mounting member 22 for removably receiving the modular headpiece B and mounting the light source module C. The interchangeable headpiece B is attached to the upstanding member 22 via one or more threaded fasteners 23*a*, 23*b*, 23*c*, and 23*d*. The upstanding portion may include a series of fins 24 and channels 26 which may serve to reduce the weight of the unit and/or operate as a heat sink member for the dissipation of heat generated by the light source module C. The light source module C may be threadably mounted to the headpiece B. The headpiece B may be exchanged with other headpieces specifically adapted for a desired light source module C.

The base member A may include a switch 28 which is coupled to the circuit board within the base member for switching operation of the light source module C between strobe and continuous beam operation (e.g., having a 6 Hz blink rate, although other blink rates are contemplated). In an especially preferred embodiment, strobe circuitry may be incorporated in the interior circuitry, housed in base A, thereby providing strobe functionality to any selected light source module C, including those which may otherwise lack strobe functionality.

The light source module C may be of any desired wavelength or wavelengths, including wavelengths in the visible and infrared (IR) regions. The light source module C may be used for example, as a target illuminator, tactical light, or the like. The light source module C may be, for example, one or more incandescent (including halogen) lamps or light-emitting diode (LED) light source, and may be comprised of one or more illumination elements located at or near the focal point of the reflector surface defined by the first and second reflectors 58 and 60 to generate a conical light pattern. The modular nature of the unit 10 makes it possible to replace the light source module C with another module C having a flashlight with a desired wavelength and/or illumination pattern.

The circuit board, not shown, housed in base A provides power from the battery module D to contacts 30*a* and 30*b* which are coupled to aligned power supply contacts or terminals on headpiece B to power the light source module C. A signal from an actuator, such as a handgrip actuator 50 (see FIG. 11) or other remote actuator may be transmitted via conductors carried within a rail interface to a connector 32 with contacts 33 located on the base member A (see FIG. 4). In an alternative embodiment, a 4-pin connector 34 having a first pair of contacts 35 and a second pair of contacts 37 is provided (see FIG. 7) wherein one of the pairs of contacts 35 and 37 carries an actuation or control signal from a remote actuator and the other pair of contacts 35, 37 provides power to other weapon mounted modules, such as a laser module or the like, via a rail mounted electrical interface. The electrical rail interface may be as described in U.S. provisional patent application No. 60/879,777 filed Jan. 10, 2007, entitled "Weapon Video Display with Floating Rail, Quick Change Power Supply, and Thermal Camera"; U.S. provisional patent application No. 60/879,897, filed Jan. 11, 2007, entitled "Modular Weapon Video Display System"; U.S. provisional patent application No. 60/920,106, file Mar. 26, 2007, entitled "Floating Rail System"; and U.S. patent application Ser. No. 11/972,426 filed Jan. 10, 2008, entitled "Floating Rail System"; each of which are incorporated herein by reference in its entirety.

Figure 6:
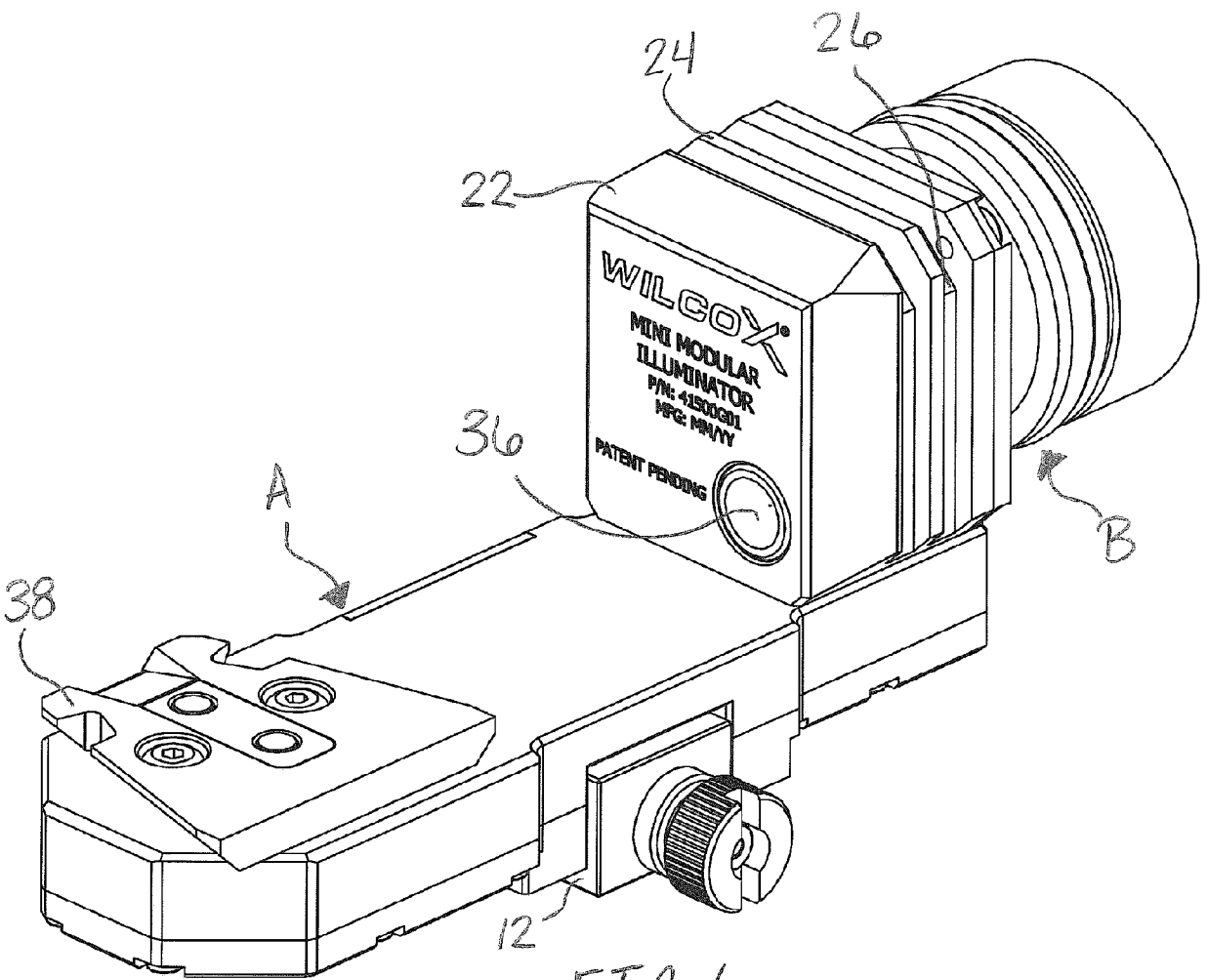
FIG. 6 is a rear isometric view of the embodiment appearing in FIGS. 2 and 3.
Figure 7:
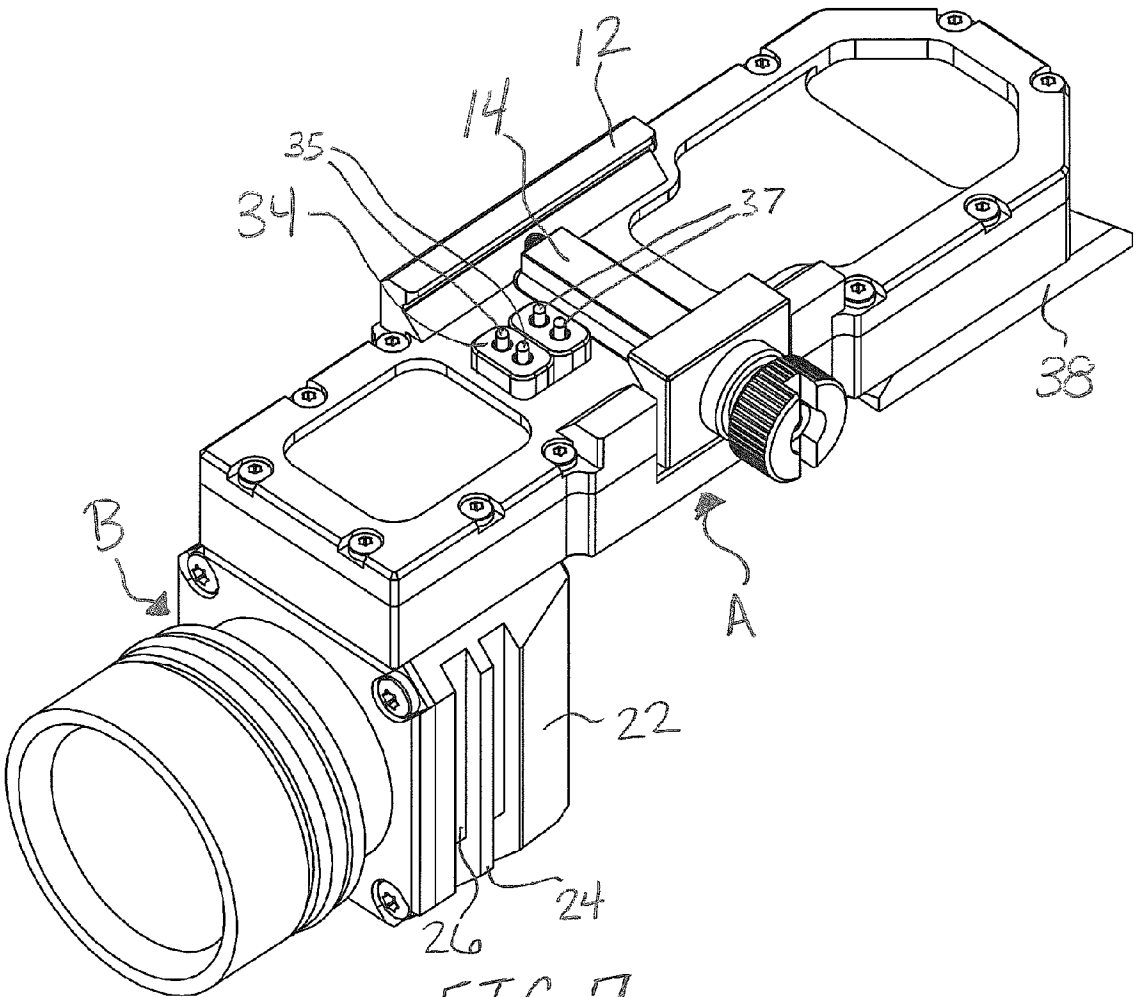
FIG. 7 is a bottom isometric view of an alternative embodiment having a 4-pin connector configuration.
Figure 8:
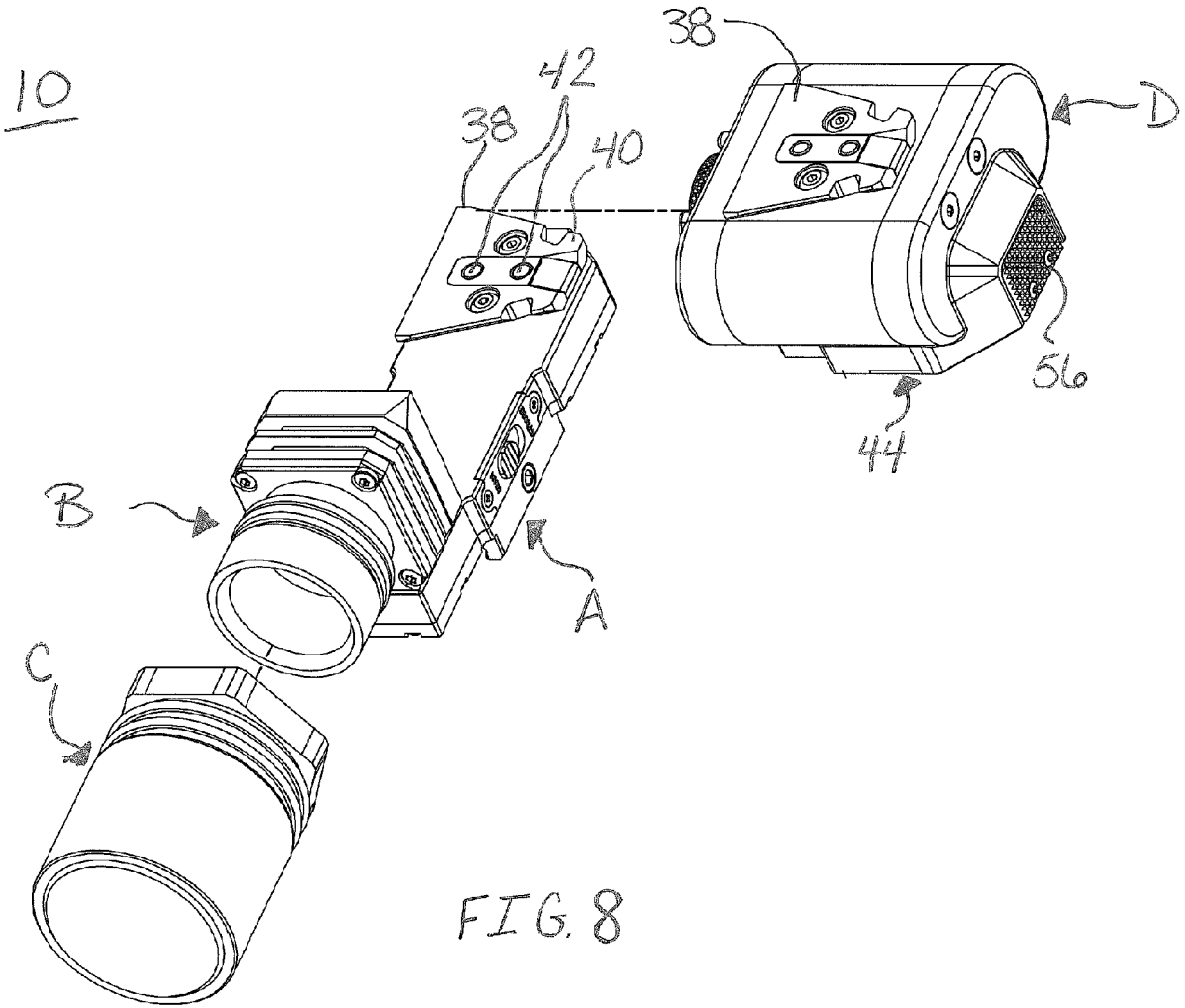
FIGS. 8 and 9 are exploded isometric views of the modular flashlight embodiment shown in FIG. 1.
Figure 9:
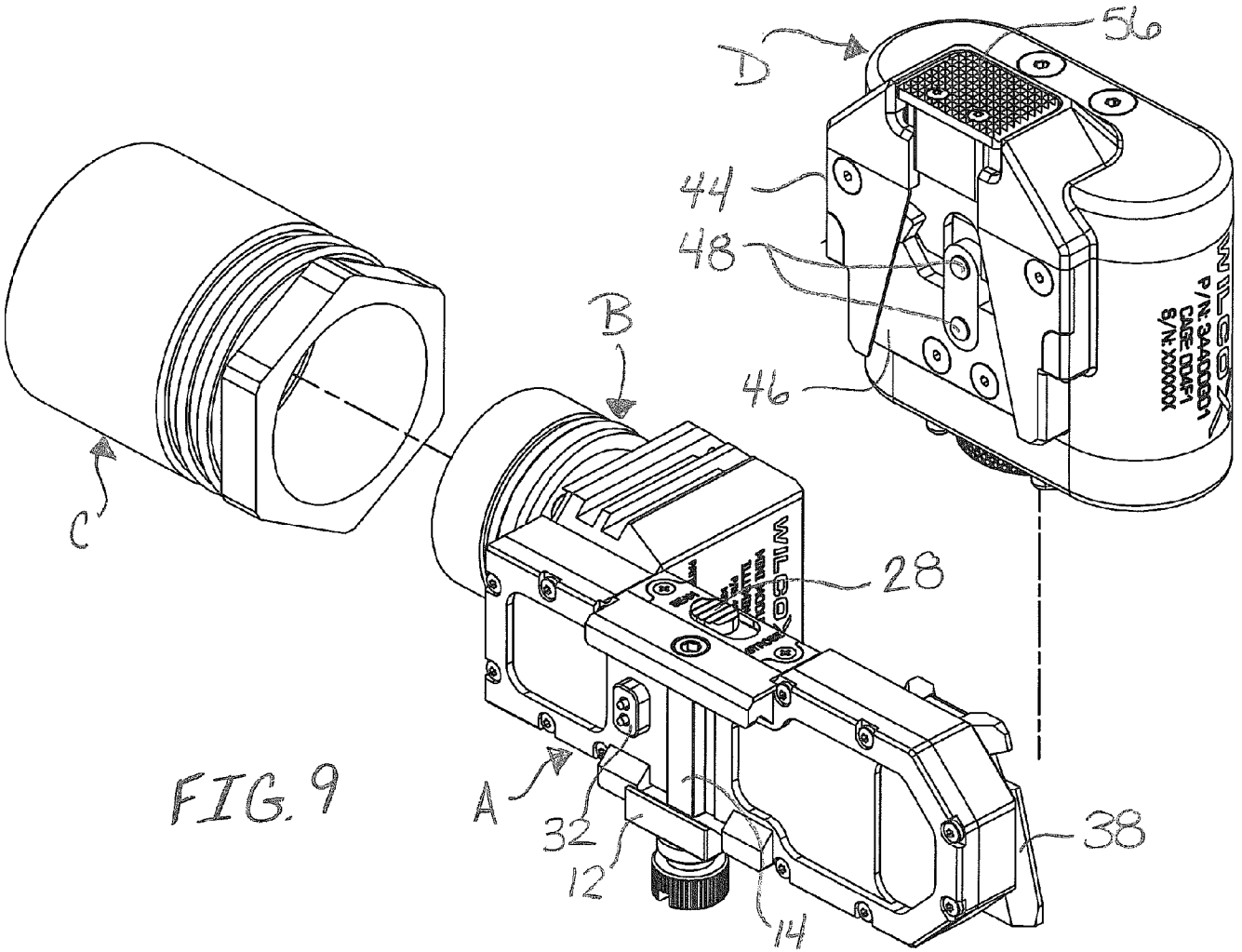
Figure 10:
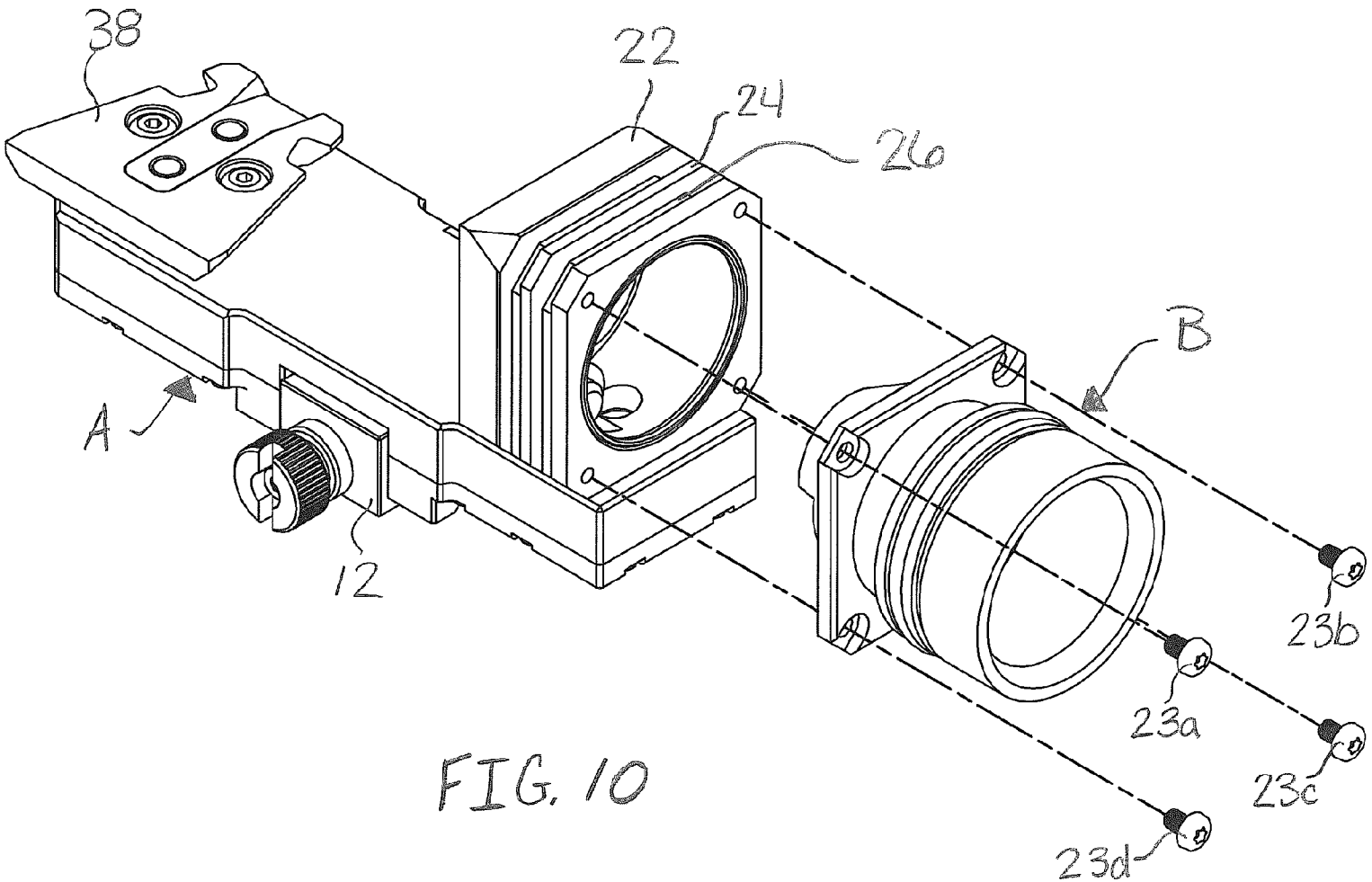
FIG. 10 is an exploded isometric view of the base assembly and modular head piece portions of the modular flashlight embodiment shown in FIGS. 2 and 3.

In the depicted embodiment, a plug connector port 36 is provided for receiving a connector from an external actuator, such as a handgrip actuator 50 for attachment to the firearm and having one or more switches 52 or like actuators for selectively actuating the light source module C. In certain embodiments, the actuator may include a selector switch for selecting between multiple light sources. For example, one light source may be an illumination light source such as the light source module C and another light source may be a laser light source, such as a laser sight. FIG. 6 illustrates such a port 36 for electrically coupling a pressure pad actuator, for allowing the light source C to be actuated using a standard or conventional pressure pad actuator. Electrical power is supplied to the light source by power supply module D, which contains one or more batteries or battery packs. Power supply module D is preferably of a quick connect and disconnect type to permit the power supply to be rapidly changed.

In certain embodiments, the hand grip unit 50 may be as described in U.S. application Ser. No. 11/651,743 filed Jan. 10, 2007, entitled "Hand Grip Apparatus for Firearm", the entire contents of which are incorporated herein by reference.

In the depicted embodiment, the power supply module D is removably affixed to the base module A via a foot and shoe type mounting system. A mounting foot 38 on the base member A includes a tapered dovetail shaped attachment mechanism 40 and electrical contacts 42. A mounting shoe 44 includes a complimentary member 46 with a tapered opening and electrical contacts 48. In operation, the attachment mechanism 40 of the mounting foot 38 is inserted into the opening of the member 46 to removably attach the power supply module D to the base module A. The electrical contacts 42 couple the power supply module D to the circuit board in the base module A to provide power to the light source module C via the headpiece module B and additional control circuitry for controlling the optical output of the light sources of light source module C.

The power supply module D contains a quick release button 56 to enable the power supply to be quickly replaced when the battery runs out. Alternatively, additional power supplies may be attached to power supply module D via the mounting foot 38 located on the top of each power supply and the mounting shoe 44 located on the bottom of each power supply, as seen on power supply module D. When additional power supplies are added an electrical (e.g. parallel) connection is formed via electrical contacts 42 and 48. Thereby allowing the operator to have a power supply with a longer life or enabling the operator to attach additional power supplies to power supply module D when the battery is running low or has run out.

Figure 11:
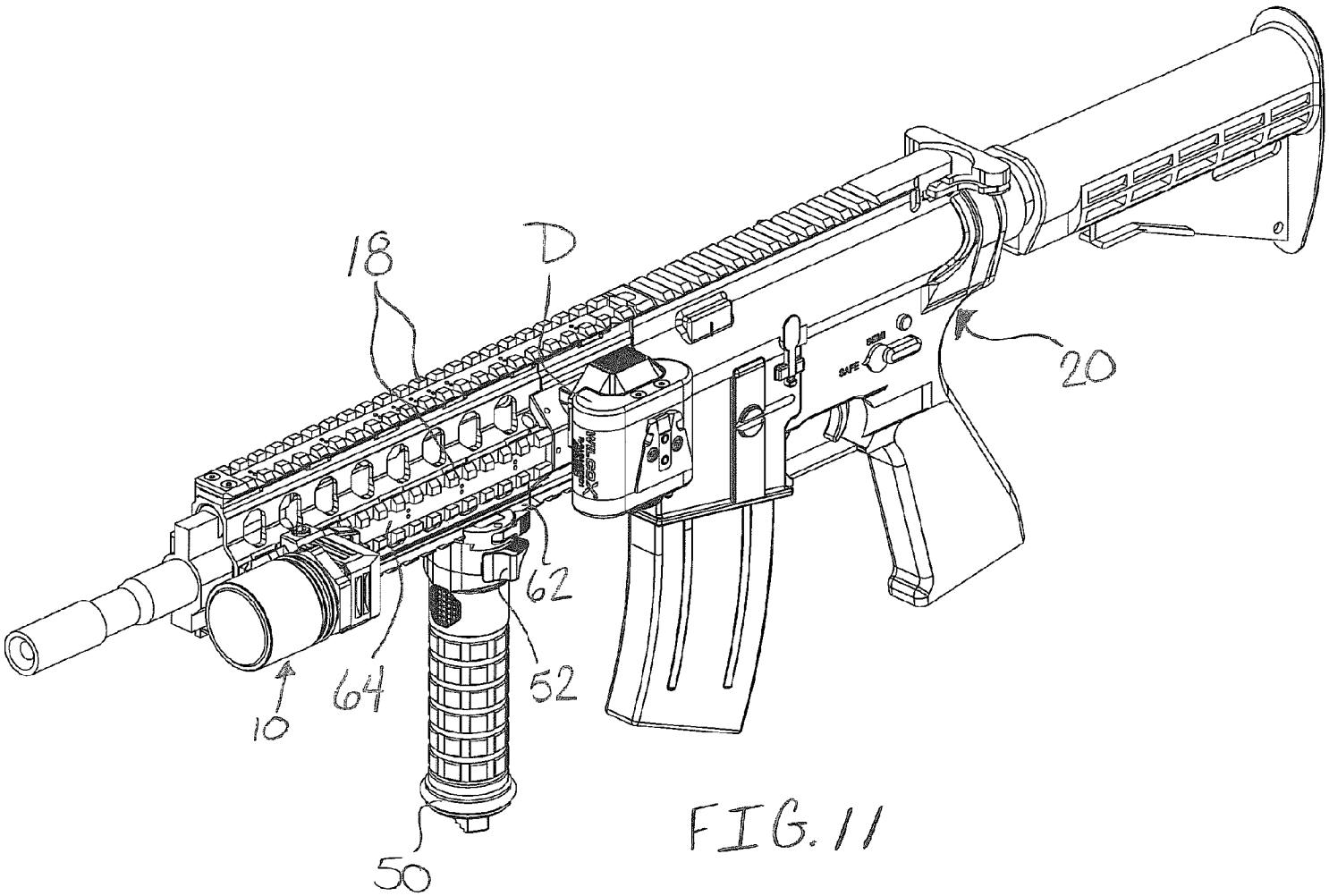
FIG. 11 is an isometric view of a flashlight system incorporating separate light source and battery modules mounted on a firearm and incorporating a handgrip actuator.
Figure 12:
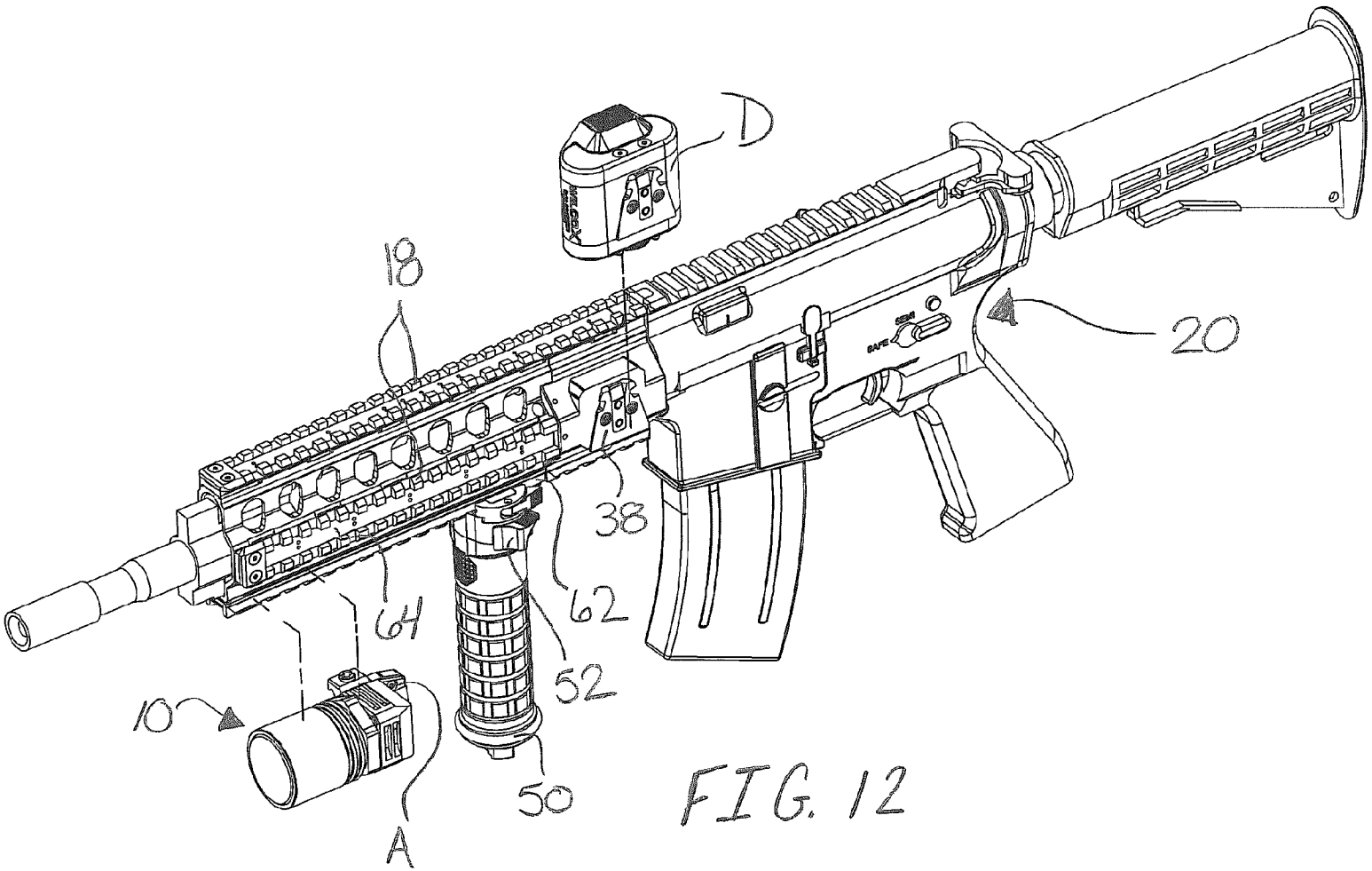
FIG. 12 is an exploded isometric view of a firearm and unattached modular light source and battery.
Figure 13:
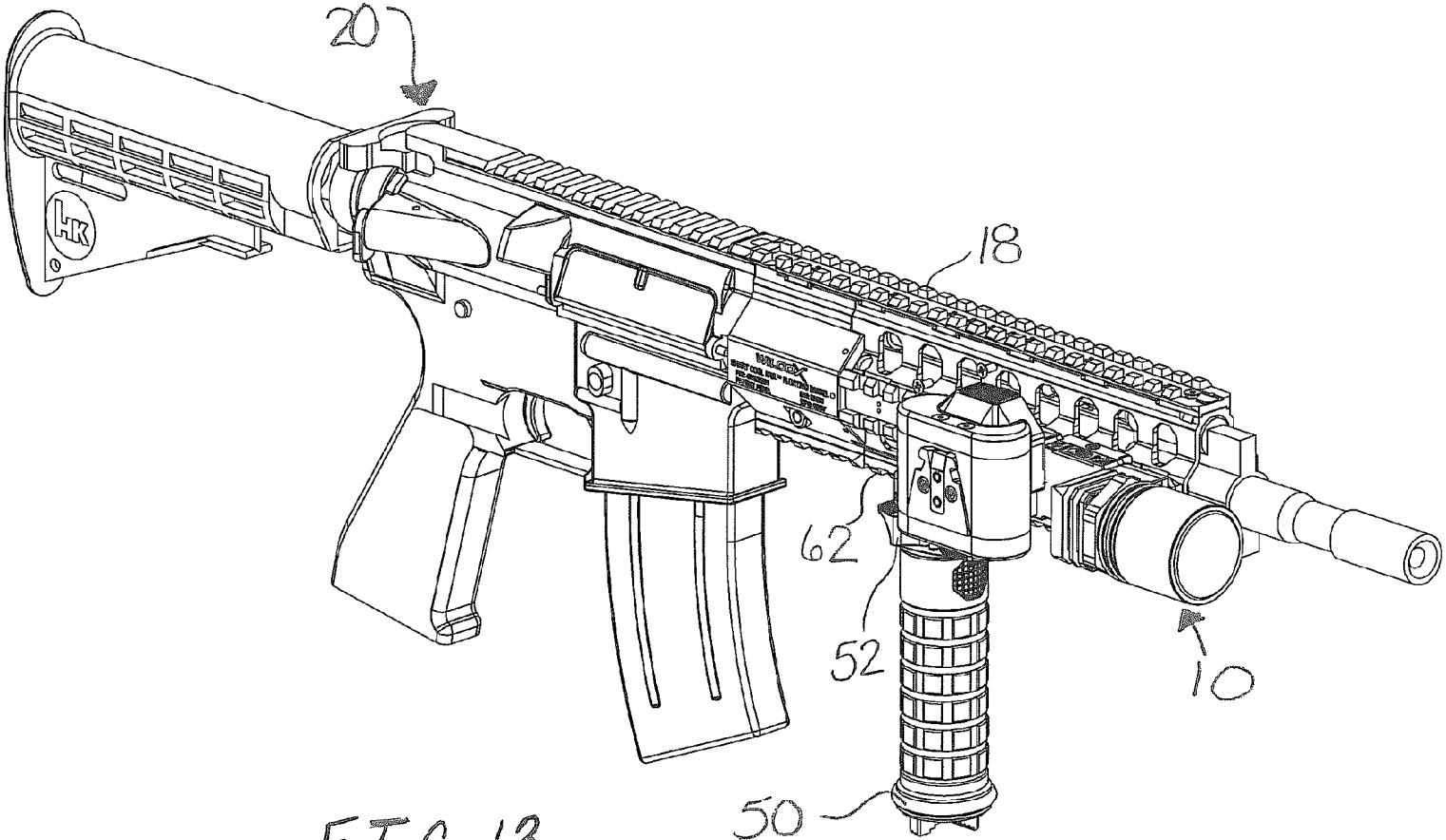
FIGS. 13-15 are isometric views of a flashlight system incorporating the embodiment of FIG. 4 or FIG. 7 mounted on a firearm and incorporating a handgrip actuator.
Figure 14:
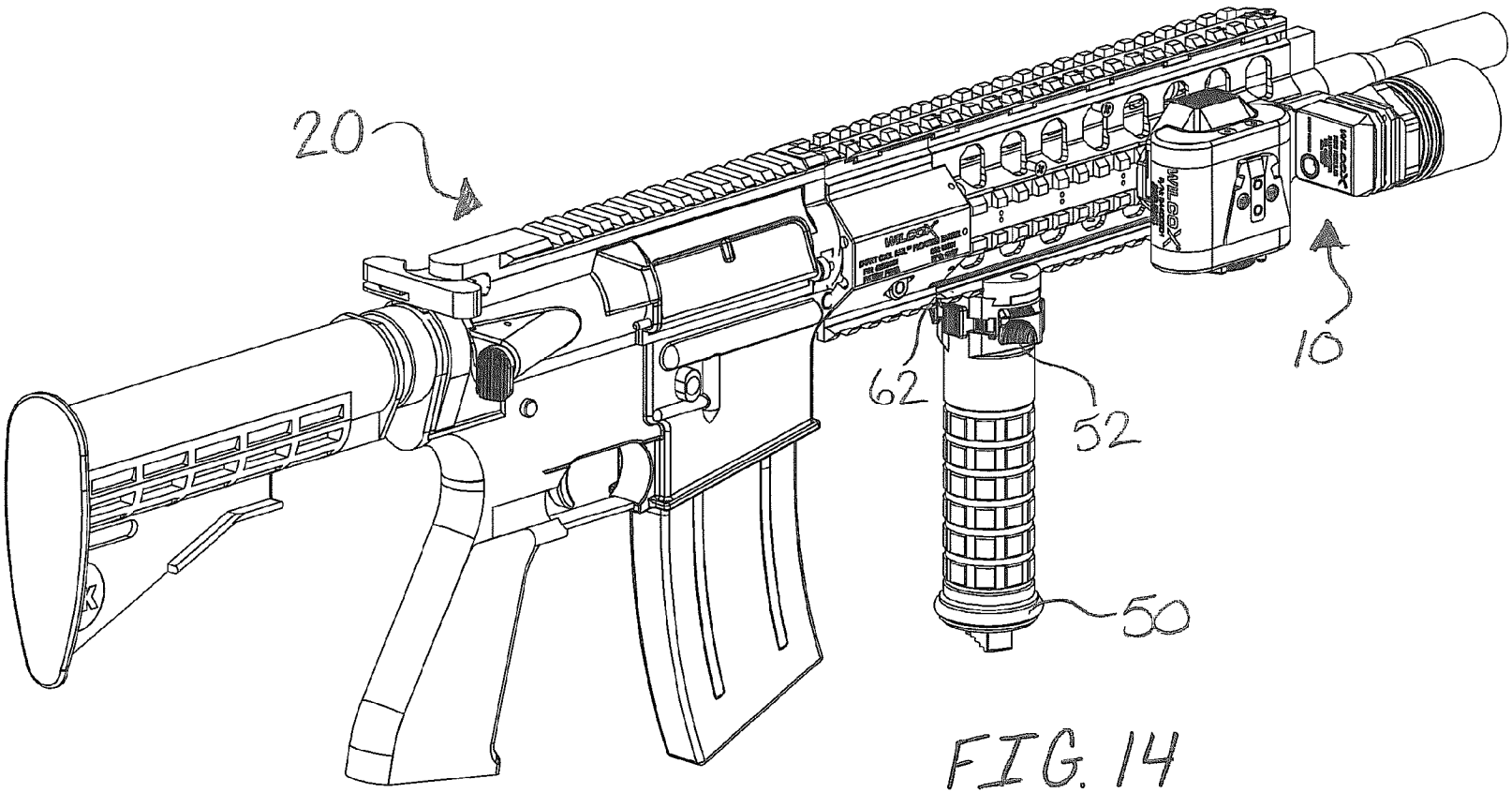
Figure 15:
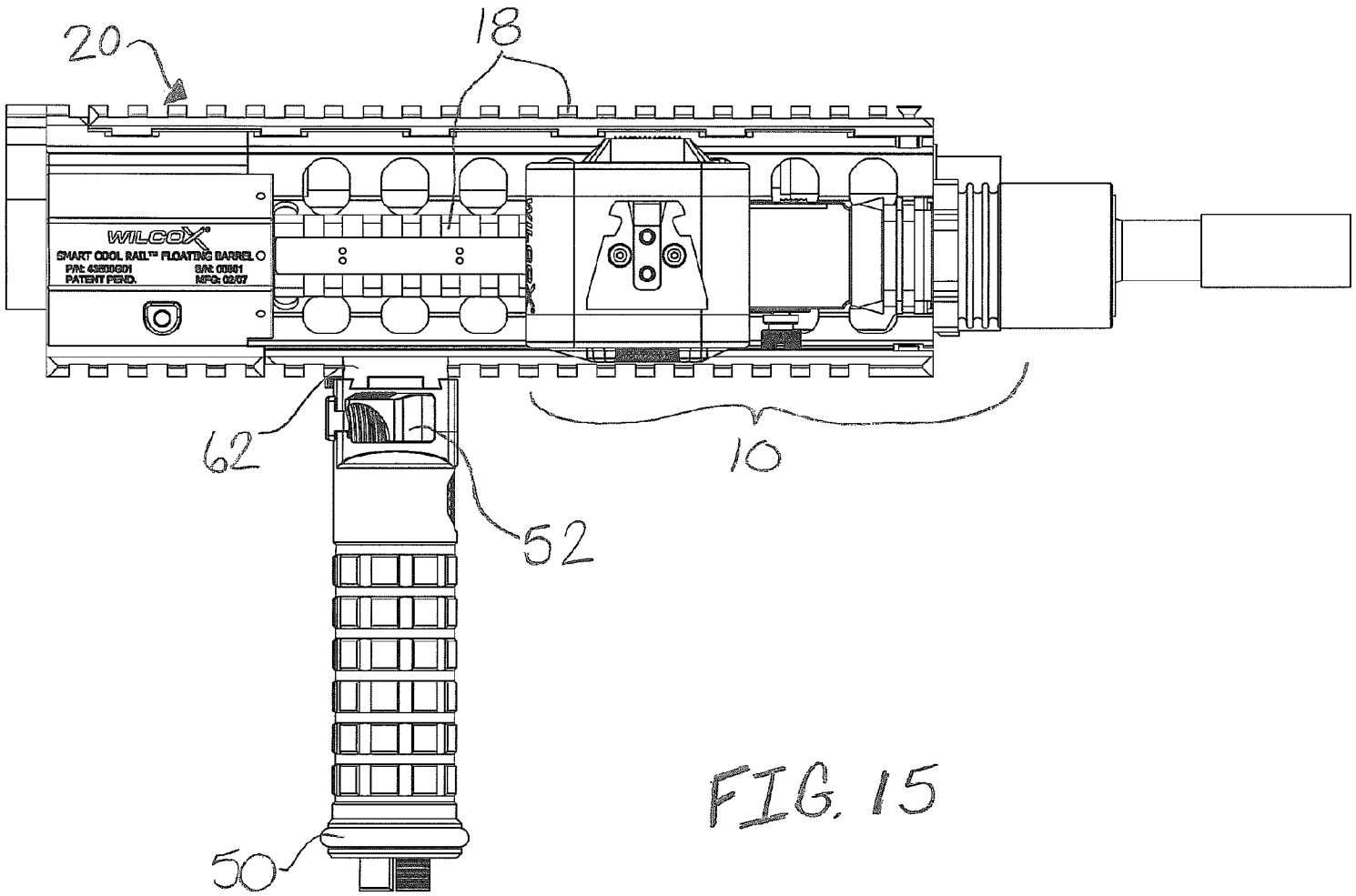

FIGS. 11 and 12 show an alternative method of powering flashlight module 10 by attachment of the power supply module D directly to a firearm 20 via a power mounting member 64, which may be as described in the aforementioned U.S. patent application Ser. No. 11/972,426 filed Jan. 1, 2008. The power supply module D can be attached at any desired position on the firearm 20 to give the user more versatility in positioning and arranging the accessory devices. Once attached to a desired position on the rails 18, the electrical contacts 48 of the power supply module D form an electrical connection to the rail circuit board 64 via the longitudinally-extending rail conductors on the rail circuit board 64.

Also shown in FIGS. 11-15 is the handgrip actuator 50 which is connected to the bottom rail 62. Once the handgrip actuator 50 is at the desired position on a rail 18, an electrical connection is created via the rail circuit board 64, thereby providing an electrical coupling between the power supply module D and the handgrip actuator 50. In certain embodiments, a signal bus may also be provided, wherein signals are transmitted via signal conductors on the rail circuit board 64, thereby allowing signals to be sent from handgrip actuator 50 to control other attached accessory devices.

The invention has been described with reference to the preferred embodiments. Modifications and alterations will occur to others upon a reading and understanding of the preceding detailed description. It is intended that the invention be construed as including all such modifications and alterations insofar as they come within the scope of the appended claims or the equivalents thereof.

The invention claimed is:

1. A modular flashlight system for firearms, the modular flashlight system comprising:

a base module including a first housing enclosing an electrical circuit component, a first fastener adapted for removably securing said base module to a firearm accessory mounting rail, and a second fastener;

a modular headpiece removably attached to the base module;

a power supply module removably attachable to the base module, the power supply module including a second housing enclosing a power source and a third fastener, the third fastener adapted for a quick attachment to and removal from the second fastener, wherein the second and third fasteners include electrical contacts which cooperate to electrically couple the power source and said electrical circuit component when the power supply module is attached to the base module; and a flashlight module removably attachable to said headpiece.

2. The modular flashlight system according to claim 1, further comprising:

said base module having a mounting member defining a receptacle for removably receiving at least a portion of said headpiece module.

3. The modular flashlight system according to claim 1, further comprising:

said electrical circuit component including a circuit board housed within said base module for electrically coupling said power supply module and said flashlight module.

4. The modular flashlight system according to claim 1, further comprising:

said flashlight module including an illumination light source and a laser light source.

5. The modular flashlight system according to claim 4, further comprising:

said illumination light source including one or more light elements, each light element selected from among an LED, an incandescent lamp, and combinations thereof.

6. The modular flashlight system according to claim 4, further comprising:

said illumination light source is selected from a visible light source, an IR light source, or combinations thereof.

7. The modular flashlight system according to claim 4, further comprising:

said laser light source selected from one or more visible laser light sources, IR laser light sources, or a combination thereof.

8. The modular flashlight system according to claim 1, further comprising:

a selector switch disposed on said first housing and electrically coupled to said electrical circuit component for selectively switching said flashlight module between strobe and continuous beam operation.

9. The modular flashlight system according to claim 1, further comprising:

a switch electrically coupled to the power supply module for selectively powering on and off the flashlight apparatus.

10. The modular flashlight system according to claim 1, further comprising:

said flashlight module including a variable light source having a plurality of light sources selected from one or more light-emitting diodes, one or more incandescent lamps, one or more laser light sources, and any combinations thereof.

11. The modular flashlight system according to claim 10, further comprising:

said plurality of light sources are selectable to produce light having a wavelength in a visible region, an IR region, or combinations thereof; and a switch for selectively activating each one or more of said plurality of light sources.

* * * * *